United States Patent [19]

Warrick

[11] 4,044,651

[45] Aug. 30, 1977

[54] PNEUMATIC FUNCTION GENERATOR ASSEMBLY

[75] Inventor: James C. Warrick, Euclid, Ohio

[73] Assignee: Bailey Meter Company, Wickliffe, Ohio

[21] Appl. No.: 720,911

[22] Filed: Sept. 7, 1976

Related U.S. Application Data

[63] Continuation of Ser. No. 576,904, May 12, 1975, abandoned.

[51] Int. Cl.[2] ..... F15B 13/16; F01B 31/00

[52] U.S. Cl. ..... 91/47; 91/388; 92/132; 137/84; 137/85

[58] Field of Search ..... 91/47, 388, 3; 137/82, 137/83

[56] References Cited

U.S. PATENT DOCUMENTS

| | | | |
|---|---|---|---|
| 2,947,553 | 8/1960 | Erbguth | 137/83 |
| 3,223,103 | 12/1965 | Trinkler | 137/83 |
| 3,633,604 | 1/1972 | Klee | 91/388 |

*Primary Examiner*—Paul E. Maslousky

*Attorney, Agent, or Firm*—Vytas R. Matas; Joseph M. Maguire

[57] ABSTRACT

A function generator is provided which establishes an output signal according to a functional relationship determined by the preformed contour of an easily precut cam member. The function generator includes a variable gain controller section coupled to a proximity sensing motion balance servomechanism which varies the gain of the controller according to the sensed proximity of the servomechanism to the edge of the cam member without physical contact therewith. The cam member's position is in turn determined by an input signal which may be related to the controller input signals or may be an independent signal from a remote source. The gain and consequently the output of the controller is varied according to the functional relationship determined by the precut contour of the cam member.

5 Claims, 5 Drawing Figures

PNEUMATIC FUNCTION GENERATOR ASSEMBLY

This is a continuation, of application Ser. No. 576,904, filed May 12, 1975 now abandoned.

BACKGROUND OF THE INVENTION

1. Field of the Invention

The present invention generally relates to function generators for producing an output signal which is a predetermined function of an input signal or signals and particularly to function generators utilizing a cam following servomechanism to produce the desired functional relationship between the input and output signals.

2. Description of the Prior Art

Prior art pneumatic controllers are known which provide a manual adjustment of the controller gain to produce an output signal which is linearly proportional to an input signal. Function generators are also known which use such controllers in conjunction with pneumatic servomechanisms to vary the gain of the controller according to the input signal to thereby produce an output signal according to a function determined by the servomechanism and the controller input signal. An example of such a function generator may be seen in U.S. Pat. No. 3,404,604.

The prior art function generators referred to above utilized a mechanical cam follower which physically engaged the contour of a preformed rigid cam member to set the gain of the controller according to the contour of the cam member. The cam member was made rotatable to provide a different contoured surface to the cam follower for different input signals. The function generator thereby was able to produce an output signal which varied as a predetermined function of the input signal. Different contoured cams provided different functional relationships. However these function generators had certain limitations arising mainly from the use of the mechanical cam follower.

In order for the cam member to provide repeatability and long life performance it had to be constructed from rigid metal materials which would not deteriorate from extended movable contact with the mechanical cam follower. This made the forming of the requisite functional cam contours difficult since the cam member had to be stamped or otherwise cut on industrial machinery. Any custom fitting of the requisite functional contour for a particular unit in the field was thus difficult if not impossible.

Further, there were limitations due to the contact of the follower to the edge of the cam by way of a roller: First, the roller was unable to follow a concave cam contour whose radius of curvature was smaller than that of the roller. Second, the roller could not be caused to roll up a step change in the cam contour.

A further limitation was imposed by the placement of the servo summing station ahead of the cam member. This placement required that any increased input signal equilibrium could only be reached by having the cam member shaped to provide a continuously increasing negative feedback signal. In practice this prevented the cam from being shaped with a contour that anywhere approached a constant radius and also prevented the cam contour from reversing its slope.

The foregoing problems associated with the prior art devices and others are solved by the present invention which will be generally described next.

SUMMARY OF THE INVENTION

In accordance with the present invention an improved function generator is provided which utilizes a unique motion balancing servomechanism to sense the edge of an easily formed flexible cam member without mechanically contacting the cam member.

This servomechanism has a movable nozzle assembly which establishes a backpressure signal dependent upon the degree of restriction of the nozzle. This backpressure signal is communicated to a piston assembly which moves the nozzle. The restriction of the nozzle is provided by the cam member and the nozzle is made to move along the surface of the cam member until it reaches the edge thereof which edge provides a balanced position of relatively unrestricted fluid flow through the nozzle.

Since the nozzle is not in mechanical contact with the cam member the need for forming the cam member from a rigid and strong material such as metal is obviated and the cam member may be formed in the field from any flexible easily cut material such as a thin plastic. Highly flexible material is in fact preferred in order to allow the cam surface to be selfaligning to the height of the nozzle. This allows for simple field adjustment and even programming of the cam member contour by simply cutting the plastic cam member with a knife or scissors to provide the desired contour and hence the functional relationship between the input and output signals of the particular field installed function generator. Also since the nozzle is very small and is oriented substantially perpendicular to the plane of the cam member, there is no minimum limitation on the size of cam features which the nozzle can follow. Also since the nozzle is positioned by the piston rather than having a roll up or down the cam, there is no limitation upon the steepness of the slope of the cam, making step changes possible.

Specific embodiments of the present invention aid the field programming or field adjustment of the cam member contour and insure that the flexible cam member is always guided into a proper relationship with the nozzle. To accomplish the foregoing the nozzle assembly is formed to have an outlet port of the nozzle oriented substantially perpendicular to one side of the cam member with a spaced guide member being formed on the opposite side of the cam member. This orientation of the nozzle and guide member allows the cam member to move freely therebetween while preventing a shock from lifting the cam member off the nozzle. Both the nozzle and the guide member also have tapered surfaces converging toward the cam member to guide the edge of the cam member toward the space provided therebetween. To provide easy programming of the cam member the guide member has an opening formed therein which is aligned with the outlet port of the nozzle. By slipping a marking pencil through this opening the side of a blank uncut cam member may be easily premarked in perfect relation to the nozzle position to the cam member. Since the mark made on the cam member will be aligned with the outlet port of the nozzle, the cam member may be easily marked for increments of desired function input to output signal relationship and then cut along the contour defined by the incremental marks to provide a programmed cam member programmed to that particular application.

From the foregoing it will be seen that one aspect of the present invention is to provide a servomechanism for a function generator that will accurately follow complicated functional contours such as steps and reverse slopes.

Another aspect of the present invention is to provide a servomechanism for a function generator that will accurately follow a contour of a cam member without being in physical contact with the cam member.

Yet another aspect of the present invention is to provide a flexible cam member for a function generator which is easily programmed and formed in the field to provide a desired functional relationship for a particular function generator.

These and other aspects of the present invention will be more fully appreciated upon a review of the following description of a preferred embodiment of the present invention and the associated drawings.

DESCRIPTION OF THE PREFERRED EMBODIMENT

Figure 1:
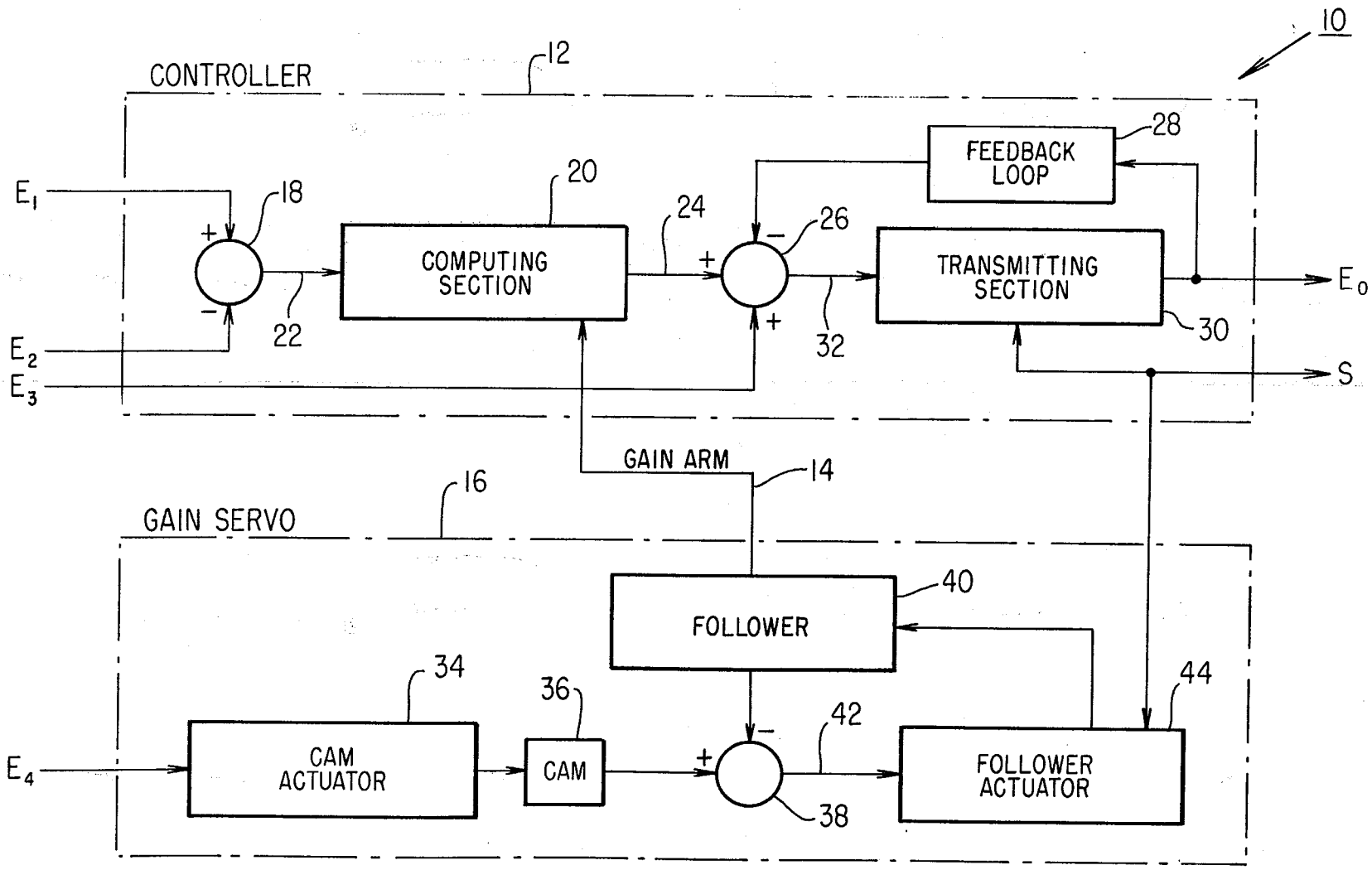
FIG. 1 depicts a functional block diagram of the function generator of the present invention.

Referring now to the drawings it will be understood that the showings therein are made for the purpose of describing a preferred embodiment of the invention and that the invention is not limited thereto.

Turning specifically to FIG. 1, a function generator assembly 10 is shown to be powered by a main power supply S. The function generator 10 includes a controller assembly 12 whose gain arm 14 is automatically adjusted by a gain servomechanism assembly 16 to provide an output signal $E_0$ from the controller assembly 12 which will be a function of input signal $E_3$ and of input signals $E_1$, $E_2$, multiplied by the setting G of the gain arm 14 which is set as a function of the input signal $E_4$.

The controller assembly 12 may be any well known electric or pneumatic controller. The controller assembly 12 compares the input signals $E_1$ and $E_2$ in a summing station 18 which provides a signal indicative of the difference between the signals $E_1$ and $E_2$ to a computing section 20 along line 22. Usually one of the signals $E_1$ and $E_2$ is a reference signal and the other signal is a measured variable signal. The computing section 20 multiplies the received difference or error signal by a gain C determined by the setting of the gain arm 14 and transmits this multiplied signal along line 24 to a second summing station 26. The second summing station 26 compares the transmitted signal from line 24 with the $E_3$ input signal and with a feedback signal derived from the output signal $E_0$ and received from a feedback loop 28. The feedback loop 28 repositions a vane and nozzle (not shown) of the controller assembly 12 and also provides derivative and integral control action by appropriately placed restrictions and volumes in the feedback loop 28 as is well known. The output of the second summing station 26 is transmitted to a transmitting section 30 along line 32 which establishes the output signal $E_0$.

The gain servomechanism assembly 16 positions the gain arm 14 and consequently sets the gain G of the controller assembly 12 in response to the input signal $E_4$. To accomplish this the signal $E_4$ is transmitted to a cam actuator 34 which rotates a cam 36 a predetermined angle as determined by the level of the input signal $E_4$. A summing station 38 relates the radius of the set angular position of the cam 36 to the position of a cam follower 40 and provides a signal along line 42 to a cam follower actuator 44 whenever the position of the follower 40 does not properly correspond to the radius of the cam 36. The actuator 44 upon receipt of the signal along line 42 drives the follower 40 with respect to the radius of the cam 36 until a properly corresponding position with respect to the cam 36 is reached by the follower 40. The summing station 38 is then at balance and the follower 40 remains stationary until a new cam 36 position is effected by a different input signal $E_4$. The follower 40 is coupled to the gain arm 14 and moves the gain arm 14 whenever the follower 40 is moved by the actuator 44. Thus the gain G of the controller assembly 12 is varied according to the level of the input signal $E_4$.

Figure 2:
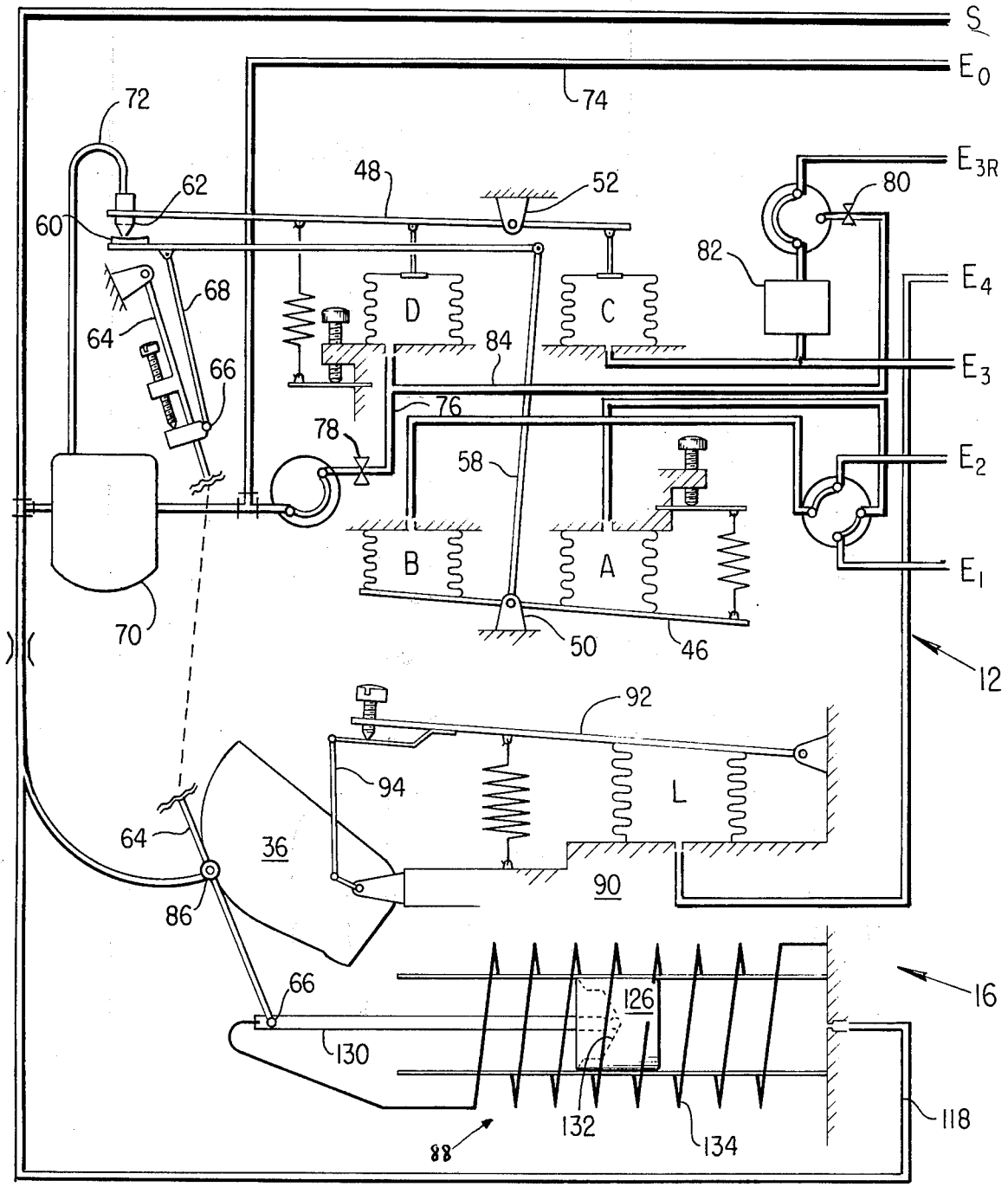
FIG. 2 is a schematic diagram of the function generator functionally depicted in FIG. 1.

Referring now to FIG. 2 it may be seen that the pneumatic controller assembly 12 includes a pair of beams 46 and 48 having respective pivot points 50 and 52 which function as the first and second summing stations 18 and 26 of FIG. 1. The input signals $E_1$ and $E_2$ are supplied to respective bellows A and B mounted to the beam 46 at opposite sides of the pivot 50 and produce a deflection of the beam 46 dependent upon the difference in pressure provided to the bellows A and B by the signals $E_1$ and $E_2$. Thus if one of the input signals $E_1$, $E_2$ is a measured variable and the other is a reference set point the deflection of the beam 46 is an indication of the error signal therebetween. The deflection of the beam 46 is transmitted by a linkage assembly 58, which corresponds to the line 22 of FIG. 1 which connects the first summing station 18 to the computing section 20 of FIG. 1. The computing section 20 of FIG. 1 is formed as a vane and nozzle assembly 60, 62 coupled to a sector arm 64 which functions as the gain arm 14 of FIG. 1. The sector arm 64 is linked to the vane 60 through its common connecting point 66 coupling a ratio link 68 to the vane 60. The vane 60 is thus responsive to movement of the sector arm 64. Deflection of the beam 46 moves the vane 60 through the linkage assembly 58 with respect to the nozzle 62 and produces a new nozzle 62 backpressure condition causing an unbalance of the beam 48 which must be rebalanced. This rebalancing is accomplished by bellows C and D which are located at opposite ends of the pivot point 52 of the beam 48. The C bellows is connected to signal $E_3$ the pressure of which must be balanced by bellows D which is connected in feedback to the output $E_0$, $E_0$ being proportional to nozzle 62 backpressure after having been amplified by booster 70.

When the vane 60 and nozzle 62 spacing initially set by the sector arm 64 is unbalanced by a direction of the beam 46 responding to new input signal $E_1$, $E_2$ the backpressure signal established by the nozzle 62 to a booster 70 along line 72 is also changed. The booster 70 provides a new amplified output signal $E_0$ proportional to the new backpressure signal along line 74. The new output signal $E_0$ is feedback connected to the bellows D by line 76. As the new output signal $E_0$ reaches the bellows D the beam 48 is deflected along with the nozzle 62 mounted thereto to restore the original vane 60 and nozzle 62 spacing under the new output $E_0$ condition.

Derivative control action may be provided to the controller 12 by delaying the application of the balance restoring output signal $E_0$ to the bellows D. This is accomplished by placing a restrictor 78 in the feedback line 76 connecting the output $E_0$ to the bellows D. Similarly integral control action may be provided to the controller 12 by placing a restrictor 80 and a volume 82 in series between the booster 70 and the C bellows in line 84 connecting the two as is well known.

Since the controller 12 varies the output $E_0$ as a function of the input signals multiplied by the set gain G of the controller it is incapable by itself of producing a non-linear output $E_0$ in response to a linear input or vice-versa. To allow such linear to non-linear input-output relationships the gain servomechanism 16 is utilized to automatically vary the setting of the sector arm 64 and hence the gain G of the controller 12 according to the level of the input signal $E_4$.

The gain servomechanism 16 is a motion balance servomechanism which includes a servo nozzle 86 which seeks the edge of the cam 36 wherealong it is balanced and remains in a stationary position. This combination of cam 36 and nozzle 86 relationship acts as the summing station 38 of FIG. 1. When the nozzle 86 is displaced from the edge of the cam 36 by a new cam 36 position the backpressure signal of the nozzle 86 changes and is transmitted to a piston assembly 88 which acts as the actuator 44 of FIG. 1 to drive the nozzle 86 back to the edge of the cam 36. Since the nozzle 86 is mounted to the sector arm 64, repositioning of the nozzle 86 to the edge of the cam 36 also repositions the sector arm 64 and changes the gain G of the controller as was discussed earlier. Thus it is seen that rotating the cam 36 causes the nozzle 86 to move to different cam 36 edge positions and causes the controller 12 to provide different gain G settings.

Figure 5:
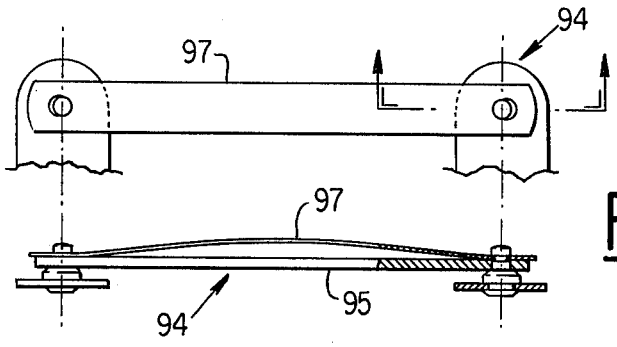
FIG. 5 is an expanded view of the connecting member coupling the cam member to the input bellows in the function generator of FIGS. 3 and 4.

The cam 36 rotates in response to the signal $E_4$. To accomplish this a bellows L is mounted between a rigid surface 90 and a pivoted bellows beam 92 to rotate the beam 92 around its pivot point in response to the pressure of the input signal $E_4$. The beam 92 is coupled to the cam 36 by a connecting link 94 which rotates the cam 36 in response to movement of the beam 92. As may be best seen with reference to FIG. 5 the connecting link 94 includes a main rigid connecting member 95 and a flexible retaining member 97. The flexible member 97 mounts in a bowed condition over the rigid member 95 to retain the rigid member 95 between the beam 92 and the cam 36 and prevent any play therebetween.

Figure 3:
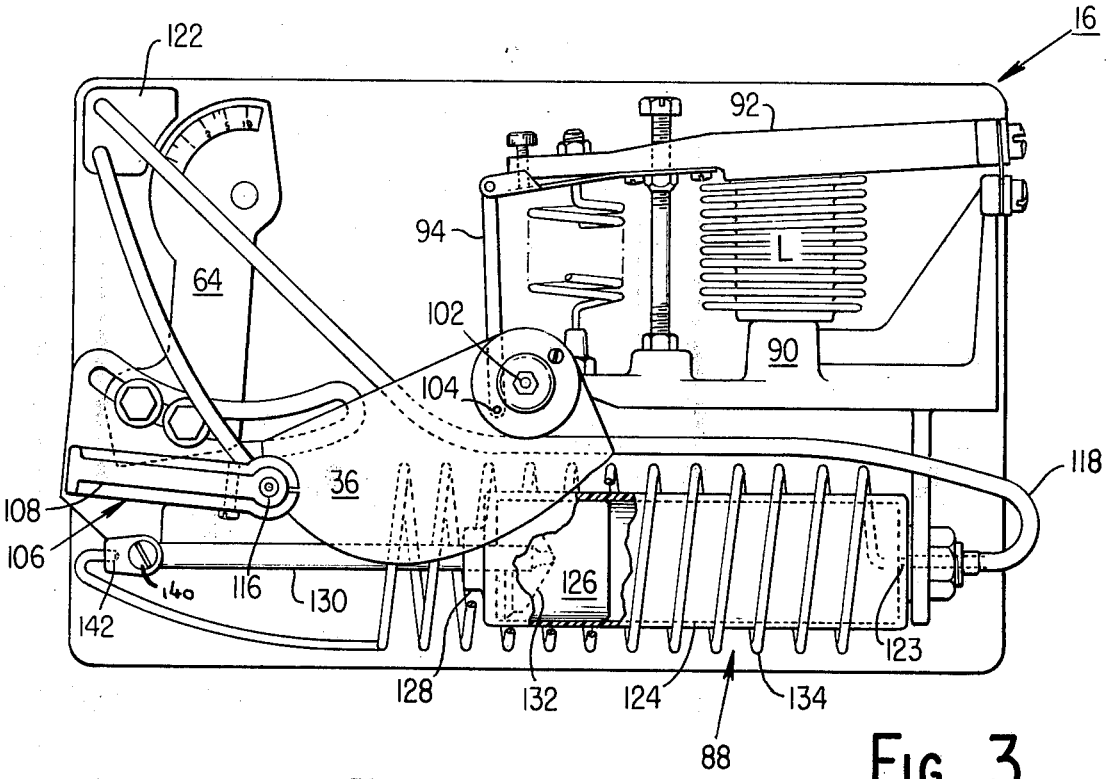
FIG. 3 is a top view of the actual function generator schematically depicted in FIG. 2.
Figure 4:
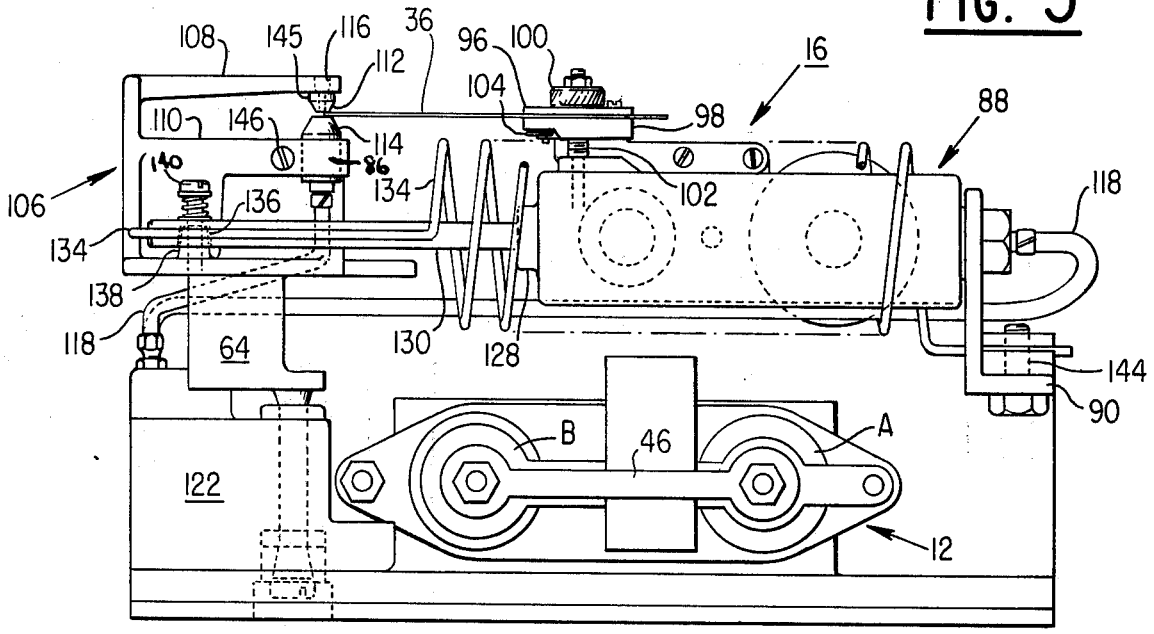
FIG. 4 is a side view of the function generator of FIG. 3.

As may be best seen with particular reference to FIGS. 3 and 4 the cam 36 is made from a thin flexible plastic material which is easily cut to the desired edge contour shape in the field as will be disclosed later. The Applicant has found that 0.007 inch thick Mylar polyester film is an acceptable cam 36 material. The cam 36 is mounted between a pair of plates 96 and 98 which are clamped together by a knurled nut 100. The assembly is made pivotable around a pivot 102. The connecting link 94 is coupled to a point 104 on the plate 98 offset from the pivot 102 to produce rotation of the cam 36 in response to linear movement of the connecting link 94.

Because of the flexible nature of the cam 36 the nozzle 86 is mounted to the sector arm 64 through a nozzle mounting and cam guide assembly 106 which insures that the cam 36 will be positively directed toward the nozzle 86 instead of bending and folding over itself upon some corner obstruction. The guide assembly 106 is formed as a U-shaped bracket having an upper and a lower leg 108 and 110 between which the cam 36 is guided by respective angled edges 112 and 114 formed on a cam guide 145 and the nozzle 86. The edges 112 and 114 are angled at approximately 45° to 60° and easily guide the cam 36 toward the nozzle 86 when a transient condition temporarily separates the cam 36 from the nozzle support assembly 106. The lower leg 110 has the nozzle 86 mounted thereto to exhaust air perpendicularly to the plane of the cam 36. This perpendicular arrangement insures that the air stream from the nozzle 86 will always impinge the cam 36 edge at a known 90° angle. The upper leg 108 has the cam guide 145 mounted thereto through which an opening 116 is formed therein in line with the nozzle 86. This opening 116 is used to mark an uncut cam 36 for programming it to provide a desired functional relationship between the inputs $E_1$, $E_2$, $E_3$, $E_4$ and the output $E_0$. The opening 116 is a circular hole of approximately 0.161 inch diameter which is stepped down to a smaller 0.047 inch diameter hole near the cam 36. This allows a finepoint felt tip pen to be easily and accurately inserted through the hole 116 to mark the cam 36 and achieve cam 36 programming and modification.

A blank cam 36 is programmed by disconnecting a flexible hose 118 which connects the piston assembly 88 to the backpressure from the nozzle 86 and reconnecting the piston assembly 88 to an external adjustable pressure source such as a hand regulator. The hose 118 is disconnected to prevent the piston assembly from driving the nozzle 86 to the unprogrammed edge of the cam 36. Since the input of the piston assembly 88 is made external, the feedback from the nozzle 86 is inoperative and the nozzle 86 can be positioned anywhere on the cam 36 radius and not just on the edge of the cam 36. Taking a chart of the desired functional relationship between inputs $E_1$, $E_2$, $E_3$, $E_4$ and the output $E_0$, the inputs $E_1$, $E_2$, $E_3$, $E_4$ are varied as per the chart in 10% increments and the hand regulator is adjusted to move the nozzle along the stationary cam 36 surface until the proper gain G is achieved by the controller to provide the desired output signal $E_0$. The cam 36 is marked at these 10% increments by inserting the felt-tip pen through the opening 116 and marking the cam 36 therewith. The marked cam is next removed from between the plates 96 and 98 by loosening the knurled nut 100 and sliding the cam 36 from between plate 96 and cam hub plate 98. The marked incremental points on the cam 36 are next connected by drawing a smooth curve through the marked points and the thin flexible cam 36 is then easily cut along the drawn curve by scissors to leave a cam 36 edge defining the marked curve. The cam 36 is now relocated between the plates 96 and 98 and the connecting hose 118 is reconnected between the piston assembly 88 and the nozzle 86. Since the nozzle 86 will position itself along the programmed edge of the cam 36 the proper relationship as per the chart will be retained between the input signals $E_1$, $E_2$, $E_3$, $E_4$ and the output signal $E_0$ due to the programmed edge of the cam 36.

The now programmed function generator 10 will operate as follows. As new input signals $E_1$, $E_2$, $E_3$, $E_4$ are applied to the function generator 10, the cam 36 will rotate to a new position either relieving or restricting the nozzle 86. Any deviation from the edge position of the nozzle 86 will affect the rate of escape of air from the nozzle 86. Any change in backpressure at the nozzle 86 is transmitted to the piston assembly 88 since the nozzle 86 and the piston assembly 88 are attached to a common volume chamber 122 in the controller 12 base. The volume chamber 122 is supplied by air bled at a rate of approximately 0.08 scfm into the chamber 122 from the air supply S to supply both the nozzle 86 and the piston assembly 88 along line 118. The volume chamber 122 is connected to the piston assembly 88 through an 0.018 inch orifice 123 located in the end of a cylinder 124 of the piston assembly 88. This orifice 123 serves to sufficiently slow the cylinder assembly 88 response to nozzle backpressure changes to prevent overshoot and achieve servomechanism 16 stability.

Certain specific features of the construction provide additional benefits. The cylinder 124 of the piston assembly 88 is formed from a precision bore Pyrex tube of 1.0000 inch I.D. Mounted within the cylinder 124 is a carbon piston 126 of 0.9993 inch O.D. by 1 inch long. The diametral clearance between the tube 124 and the piston 126 provides free movement of the piston 126 without excess bleeding of air past the piston 126. Normal cylinder 124 operating pressures are from 4.0 psi (retracted) to 8.3 psi (fully extended). These pressures are determined by a cylinder return spring 134 made from No. 302 stainless spring temper wire and wound around the cylinder 124. The cylinder 124 is mounted to the base 90 and sealed thereto by a Buna N O-ring (not shown). The O-ring not only seals the pressure in the cylinder 124 but also extends slightly beyond the end of the cylinder 124 base to provide a cushion or minimum overtravel stop for the piston. A clear polyolefin heat shrinkable tube 128 is heat shrunk over the cylinder 124 to partially cover the end of the cylinder 124 to not only retain the piston 126 but also to create a maximum overtravel stop to prevent the piston 126 from popping out of the cylinder 124 under high backpressure conditions. Clear heat-shrinkable tubing 128 is used to allow inspection of the O-ring, the piston 126, and the cylinder bore without disassembly thereof. The carbon piston 126 glass cylinder 124 combination provide benefits such as a low coefficient of friction, and similar temperature expansion rates. There is only 0.0001 inch differential expansion over a 100° F temperature span. Breakaway $\Delta P$ is only 0.1 psi.

A connecting rod 130 transmits the piston 126 motion to the sector arm 64 by its connection thereto. On one end the connecting rod 130 is not attached to the piston 126 but is guided toward the center of the piston 126 by a deep countersink 132 formed on the face of the piston 126. The connecting rod 130 is retained against the piston 126 by the return spring 134 as will be explained later. The other end of the connecting rod 130 is provided with a conical-shaped hole 136 which fits over a hemispherically-shaped protrusion 138 cast onto the nozzle support assembly 106. The two parts are preloaded gently against each other and retained by a screw 140 and a spring. The conical shaped hole 136 and preload are required to eliminate play which might otherwise exist between the connecting rod 130 and the nozzle support assembly 106, which if allowed to exist would produce instability (hunting). The hemispherical surface 138 also provides a ball joint to permit misalignment without binding.

Returning to the mounting of the spring 134, one end of the cylinder return spring 134 fits into a hole 142 formed in the end of the connecting rod 130 with the other end being bolted to the body 90 by a screw 144. This places the connecting rod 130 in compression between the spring load on one end and the piston 126 force on the other. It should be noted that almost all the cylinder 126 force is contained with a loop defined by spring 134 to connecting rod 130 to piston 126 to air to base 90 to spring screw 144 and back to the spring 134. Only a very small component of this load thus reaches the sector arm 64 where the load could deflect the sector arm 64 and cause a null shift. It should also be noted that the design of the connecting rod permits a great deal of angular misalignment at the free end of the spring 134, which is a normal condition in springs with large ratios of outside diameter to wire diameter.

Turning next to the details of the nozzle 86 construction and mounting, the nozzle 86 is clamped to the nozzle support assembly 106 by a screw 146 and is adjustable to allow compensation for cam height variation which can result from a stackup of tolerances. The nozzle 86 has a 0.170 inch high 45° to 60° chamfer to guide the cam 36 to the nozzle face even under conditions where it has been adjusted upward to compensate for cam height tolerance stack-up. The cam 36 edge thus will not under any condition interfere with anything, but will be guided to its proper position at the nozzle 86 face. The nozzle 86 face is a blunt convex cone. In the center of the face is a 0.0220 inch dia nozzle outlet. The conical face allows the cam 36 plane to be slightly misaligned relative to the nozzle 86 axis. The nozzle 86 face confines the region of high-velocity low-pressure air escaping from the nozzle 86 outlet so that the cam 36 is drawn toward the nozzle 86 face. However it normally is not drawn against the nozzle 86 face but rides on a film of air approx. 0.001 inch above the center of the nozzle 86 face. In line with the nozzle 86 and on the other side of the cam 36 is the cam guide 145 which serves to guide the cam, if necessary, to within 0.015 inch of the end of the nozzle 86, after which the cam 36 is drawn toward the nozzle 86 by the escaping air. The cam guide 145 does not normally operate in contact with the cam 36 but is screwed down to within 0.005 inch of the cam 36 to prevent the cam from being shaken away from the nozzle 86 by a severe mechanical shock.

From the foregoing it will be seen that an improved function generator is provided which utilizes an easily programmed cam and an accurate non-contacting cam follower to produce a more accurate and flexible unit.

Certain improvements and modifications will occur to those skilled in the art upon reading this specification. Clearly the basic concepts disclosed herein could just as easily be applied to an electrical function generator. It will be understood therefore that such improvements and modifications were deleted herein for the sake of conciseness and readability but are within the scope of the claims.

What I claim is:

1. A motion balance servomechanism for a function generator comprising:

nozzle means for providing different backpressure signals in relation to restrictions of fluid therethrough;

flexible restriction means having a plane surface mounted proximate to said nozzle means to restrict fluid flow through said nozzle means; and a guide member connected to said nozzle to be located directly opposite said nozzle but spaced therefrom to allow the plane surface of said flexible restriction means to move between said nozzle and said guide member, said guide member having an opening extending therethrough which is always aligned with said nozzle, motion means for moving said nozzle means with respect to said restriction means from a position along the plane surface to a position along an edge of the plane surface of said flexible restriction means allowing substantially unrestricted fluid flow through said nozzle means, said motion means including a piston assembly having a movable piston and being connected to said nozzle means to provide different piston positions in response to different backpressure signals from said nozzle means, said piston assembly including a cylinder having one end sealably connected to said nozzle means to sense the backpressure signal therefrom and the opposite end open to ambient, a piston sealably movable within said cylinder in response to the backpressure signal from said nozzle means and flexible tubing extending partially over the open end of said cylinder to prevent said piston from moving out of said cylinder.

2. A servomechanism as set forth in claim 1 wherein said motion means includes a spring-biased connecting arm connecting said piston to said nozzle means to move said nozzle means in response to movement of said piston.

3. A servomechanism as set forth in claim 2 wherein said cylinder is formed from a glass material and said piston is formed from a carbon material to provide low friction movement of said carbon piston in said glass cylinder.

4. A motion balance servomechanism for a function generator comprising:

nozzle means for providing different backpressure signals in relation to restrictions of fluid flow therethrough including a nozzle having an outlet port;

flexible restriction means having a flexible plane surface mounted perpendicularly to the nozzle of said nozzle means to restrict fluid flow through said nozzle;

a guide member connected to said nozzle to be located directly opposite said nozzle but spaced therefrom to allow the plane surface of said flexible restriction means to move between said nozzle and said guide member, said guide member having an opening extending therethrough which is always aligned with said nozzle said guide member opening beginning on one face of said guide member and terminating on a diametrically opposite face of said guide member, motion means for moving said nozzle means and said guide member along the plane surface of said restriction means from a position wherein the plane surface restricts fluid flow through the nozzle to a position along an edge of the plane surface of said flexible restriction means allowing substantially unrestricted fluid flow through said nozzle means.

5. A function generator comprising:

movable nozzle means for providing different backpressure signals in relation to restrictions of fluid flow therethrough restriction means including a cam member mounted substantially perpendicularly to said nozzle means to restrict fluid flow through said nozzle means along the plane of said cam member motion means for moving said nozzle means with respect to the plane of said cam member to a position along an edge of said cam member allowing substantially unrestricted fluid flow through said nozzle means;

a pneumatic controller having a movable gain adjusting arm for providing an output signal as a function of an input signal and the position of said gain adjusting arm, said gain adjusting arm of said controller being connected to said nozzle means to move in response to movement of said nozzle means; and coupling means for moving said cam member with respect to said nozzle means in response to the input signal of said controller, said coupling means including a rotatable pivot having said cam member mounted thereto to be rotatable therewith, a bellows assembly responsive to the input signal of said controller and having a pivotable arm member movable in response to the expansion of a bellows of said bellows assembly, a rigid connecting bar having an opening at each end thereof for connecting said pivot to the arm member of said bellows assembly and a flexible connecting bar having an opening at each end thereof spaced apart more than the openings of said rigid connecting bar with the openings of said rigid and said flexible bars being aligned when said flexible bar is bowed and placed over said rigid bar to retain said rigid bar when connecting said pivot to the arm member of said bellows assembly.

* * * * *